US007073870B2

(12) United States Patent
Tillessen et al.

(10) Patent No.: US 7,073,870 B2
(45) Date of Patent: Jul. 11, 2006

(54) BIT HOLDER FOR A PLOUGHING BIT OF A COAL OR EXTRACTION PLOUGH AND PLOUGHING BIT

(75) Inventors: Uwe Tillessen, Kamen (DE); Norbert Hesse, Bochum (DE); Gerhard Siepenkort, Lünen (DE); Klaus Duhnke, Bochum (DE); Adam Klabisch, Dortmund (DE)

(73) Assignee: DBT GmbH, Lunen (DE)

( * ) Notice: Subject to any disclaimer, the term of this patent is extended or adjusted under 35 U.S.C. 154(b) by 29 days.

(21) Appl. No.: 11/000,024

(22) Filed: Nov. 30, 2004

(65) Prior Publication Data

US 2005/0140099 A1 Jun. 30, 2005

(30) Foreign Application Priority Data

Dec. 29, 2003 (DE) ..... 203 20 161 U

(51) Int. Cl.
*E21C 27/44* (2006.01)

(52) U.S. Cl. ..... 299/108; 299/34.04

(58) Field of Classification Search ..... 299/108, 299/112, 34.04, 34.05, 34.06
See application file for complete search history.

(56) References Cited

U.S. PATENT DOCUMENTS 4,819,990 A * 4/1989 Breuer et al. ..... 299/112 R
4,998,778 A * 3/1991 Braun et al. ..... 299/108

FOREIGN PATENT DOCUMENTS

DE 299 01 985 U1 5/1999

* cited by examiner

*Primary Examiner*—John Kreck
(74) *Attorney, Agent, or Firm*—Fay, Sharpe, Fagan, Minnich & McKee, LLP

(57) ABSTRACT

A bit holder for a ploughing bit, particularly a bottom bit of a coal plough, includes an insert pocket 12 which is open at the top side 11 for receiving and supporting a bit stem of the ploughing bit and which pocket 12 is bounded on its edges by two lateral supporting walls 20, 30, a front supporting wall 13 and a rear supporting wall 14 with the rear supporting wall 14 projecting above the front supporting wall 13. In order to minimise the wear effect on the contact surfaces between bit stem and bit holder, the lateral supporting wall 20 facing away from the working face when the plough is in use projects above the front supporting wall 13 and the other lateral supporting wall 30 and forms an extended lateral support for the bit stem with respect to the other supporting wall 30.

20 Claims, 3 Drawing Sheets

Fig.1
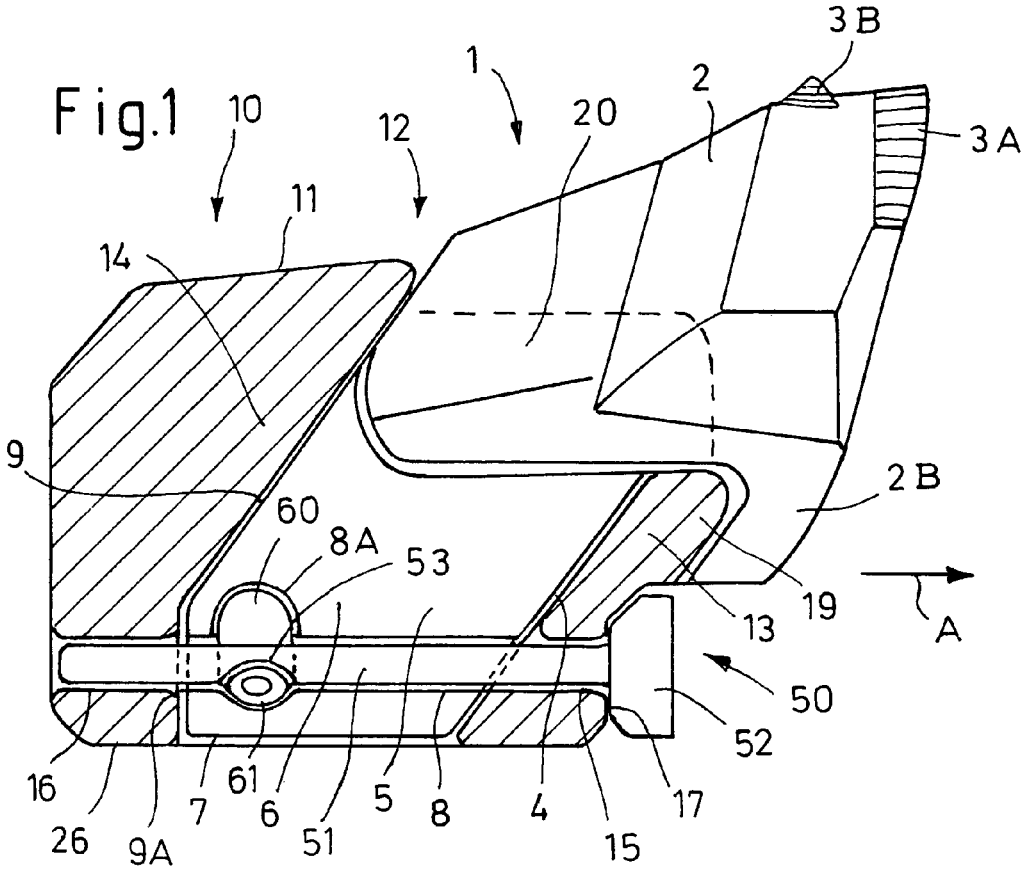
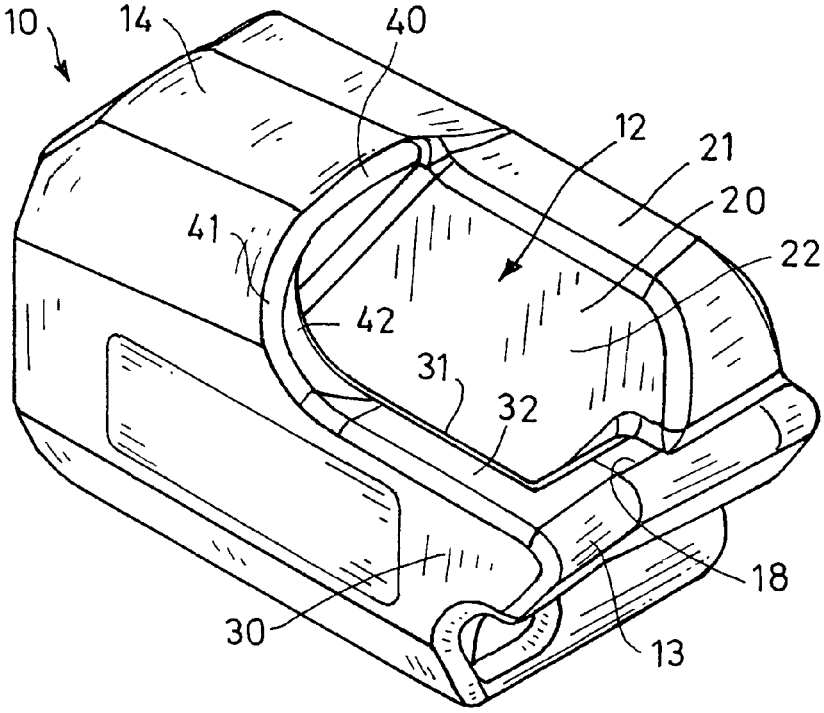
Fig.2

Fig. 3
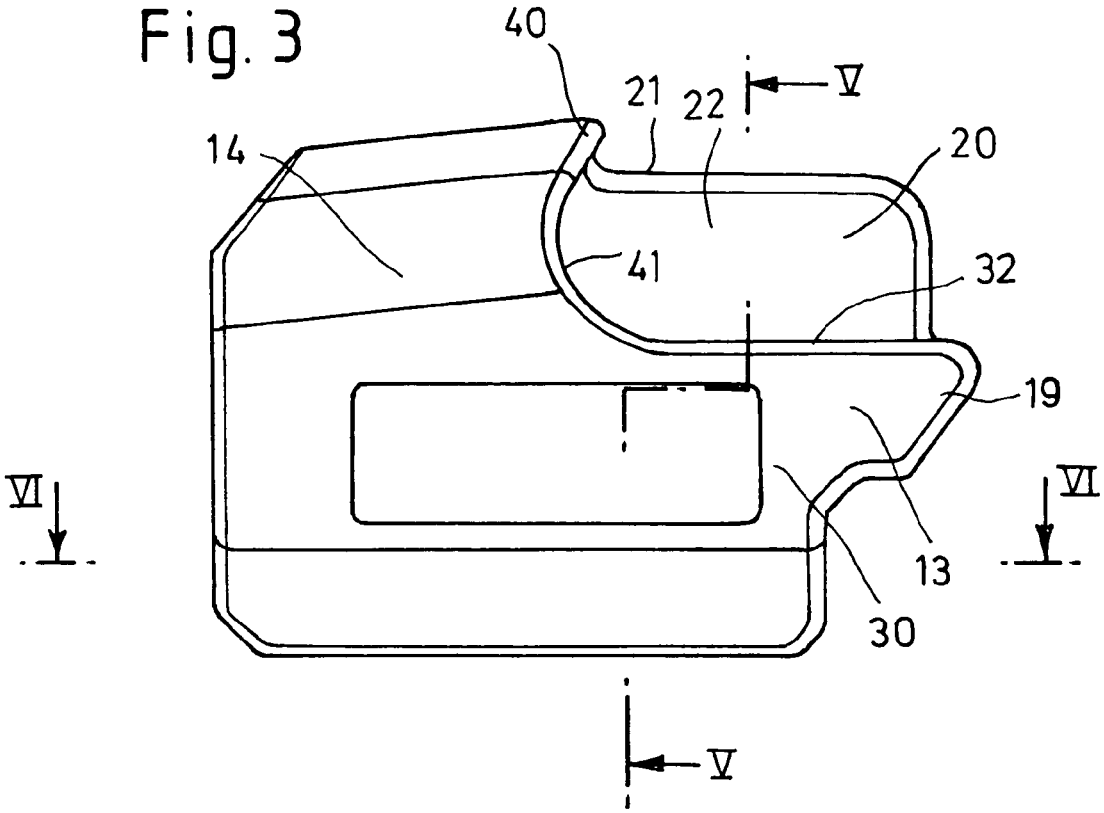
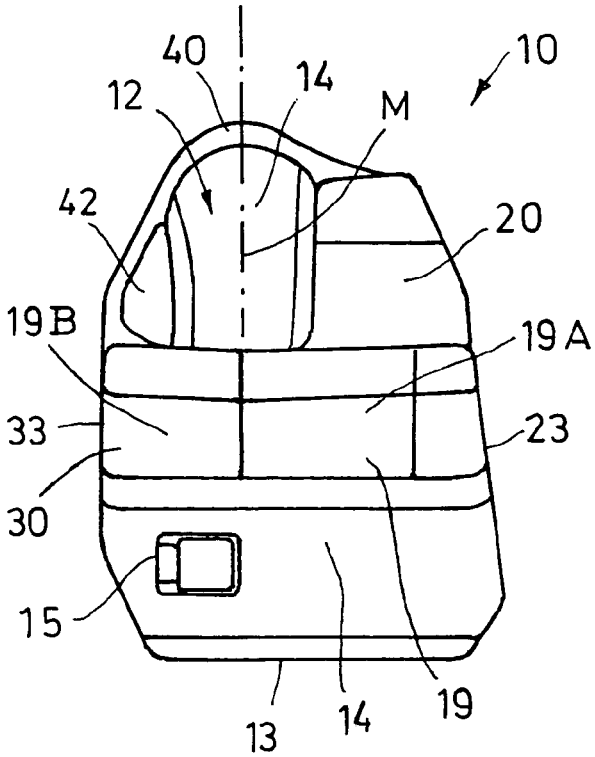
Fig. 4

BIT HOLDER FOR A PLOUGHING BIT OF A COAL OR EXTRACTION PLOUGH AND PLOUGHING BIT

The invention relates to a bit holder for a ploughing bit, particularly for the bottom bit of a coal plough or extraction plough. In one embodiment, the bit holder includes an open insert slit on the top for receiving and supporting a bit stem formed on the ploughing bit, which is bounded on its edges with respect to the plough's working direction by two lateral supporting walls, a front and a rear supporting wall, whereby the rear supporting wall projects above the front supporting wall. The invention further concerns a ploughing bit, particularly a bottom bit for a corresponding bit holder, which bottom bit comprises a bit head and a bit stem that is insertable and once there, anchorable by means of a locking pin, in the insert slit of the bit holder.

Extraction ploughs with bits and bit holders for both plough working directions, which bit holders are particularly welded onto pivotal bit carriers, have long been used by the applicant. Attached to each bit carrier of the plough and distributed over its height is a plurality of bit holders, each of which comprises an open insert pocket for receiving the bit stem of the ploughing bit. Each insert pocket of the bit holder is bounded on its edges in relation to the plough working direction by two lateral supporting walls, one front supporting wall and one rear supporting wall that projects above the front wall. At least one bit holder of one of each bit carrier serves to receive a bottom bit that cuts the coal to be mined directly at the bottom. When the extraction plough is in operation all bits are subject to high stresses, the bottom bit to extremely high stresses, that lead to excessive wear of the bottom bit. Due to these high forces the shaft of a bit holder that holds a bottom bit is also subject to comparably high stresses.

In underground mining it is necessary to replace all ploughing bits of the coal plough or winning plough regularly. The inventors of the present patent application have determined that the greater wear on the bottom bit holder is a determining factor for the length of the replacement interval for a uniform replacement interval of all ploughing bits of the coal plough or extraction plough. The applicant has observed this particularly on extraction ploughs that are fitted with the bit holders known from DE 29901 985 U1.

The generic bit holder in accordance with DE 299 01 985 U1 is, with exception of the driving bore for securing a bit, symmetrically constructed and has a rear supporting wall that projects significantly in height above both lateral support walls and the front supporting wall in order to provide large-surface support of the ploughing bit in the event both of high stresses due to the ploughing forces and of plough backward run. In the case of the generic bit holder the elevation on the rear supporting wall with respect to the plough working direction is intentionally formed in the central area only and the elevation declines towards the two lateral supporting walls. Simultaneously, the fronts of the lateral flanks of the rear supporting wall are provided with guiding surfaces in order to achieve a favourable deflection of fine coal in operation. This hereby avoids a dead space between the lateral supporting walls and the rear supporting wall which could fill with fine coal when the plough is in operation and coincidentally achieves a favourable deflection of the fine coal in operation.

Starting from this known bit holder, it is desirable to minimize the wear effect on the contact surfaces between bit stem and bit holder in the area of the insert pocket due to the high working forces that appear when the plough is in operation in order to increase the service life of the bit holder and/or of the bit inserted therein and to enable longer replacement intervals.

According to one aspect of the invention, a bit holder for a ploughing bit, particularly a bottom bit of a coal plough or extraction plough is provided. More particularly, in accordance with this aspect, the bit holder includes an insert pocket which is open at a top side for receiving and supporting a bit stem of the ploughing bit in which pocket is bounded on its edges by two lateral supporting walls, a front supporting wall and a rear supporting wall with the rear supporting wall projecting above the front supporting wall. The lateral supporting wall that faces away from the working face and/or coal face when the plough is in operation, which lateral supporting wall is consequently goaf-sided, projects both above the front as well as the opposite lateral supporting wall that faces towards the working face when the plough is in operation, and forms in relation to this opposite lateral supporting wall an extended (goaf-sided) lateral support for the bit stem. The longer lateral supporting wall forms an additional supporting shoulder particularly in the section that projects above the height of the shorter supporting wall for the lateral support of the inserted and secured ploughing bit.

One advantage is realized with the bottom bit holder since the forces introduced via the bottom bit into its bit holder, thus the stresses for the bottom bit holder, are greater than the stresses for the other bit holders. This advantage can be realised without further effort, however, in all other bit holders of a coal plough or extraction plough, as well. The longer length of the goaf-sided supporting wall results in a significantly improved support of the bit stem on the higher stressed, goaf-sided supporting wall bordering the insert pocket. This hereby counteracts a tilt inclination of the ploughing bit that is pushed into the bit holder where there is less surface pressure between the contact zones. The high transverse forces that are introduced into the ploughing bit and ploughing bit pockets when moving the conveyor that guides the extraction plough towards the working face in order to reach the cutting depth can be absorbed therefore more favourably than in the case of the prior art and a deflection or widening of the insert pocket is thereby counteracted.

In one preferred embodiment the longer lateral supporting wall projects above the shorter lateral supporting wall as far as the front supporting wall by a substantially constant height. In a further preferred embodiment the insert pocket can be disposed asymmetrically between the lateral supporting walls and be closer to the outer surface of the shorter lateral supporting wall of the bit holder than to the outer surface of the longer lateral supporting wall. Due to the asymmetrical construction of the bit pocket and due to the differing thickness of the lateral supporting walls, by which means said lateral supporting walls are accordingly adapted to their different stresses, the insert pocket of the bit holder obtains a more favourably reconciled geometry with respect to the forces to be absorbed without increasing the risk that the bit holder is subject to higher forces brought about by the loosened coal when the plough moves. Once again it is advantageous if the shorter lateral supporting wall that faces the working face is less thick than the longer, goaf-sided lateral supporting wall. The thickness of the longer lateral supporting wall preferably decreases continuously over at least a part of its height. Furthermore, the outside of the longer lateral supporting wall can run obliquely over part of its height with respect to the central longitudinal plane of the insert pocket of the bit holder.

In a further advantageous embodiment the rear supporting wall comprises an elevation preferably only in the central area, which elevation projects above both lateral supporting walls and forms an additional backward support for the ploughing bit. In order to achieve a coincidental deflection of the fine coal in a further advantageous embodiment both lateral supporting walls are formed with and/or as inclinations sloping to the insert pocket. The inclinations can particularly run obliquely at an angle of around 93° with respect to the central longitudinal plane of the insert pocket.

In a further advantageous embodiment the inner surfaces of both lateral supporting walls that laterally limit the insert pocket are flat and their distance increases from the bottom of the insert pocket upwards, i.e. to the top side of the bit holder. The inner surfaces of both lateral supporting walls can diverge particularly with respect to the central longitudinal plane of the insert pocket at an angle of around 1° to 2°, particularly around 1.8°. At the same time, as known from the prior art, the inner surfaces of the front and the rear supporting wall should be inclined with respect to the plough working direction. The angle of inclination in the event of the particularly preferred embodiment is around 50° to 60°, particularly 54.5°±1°. The bottom of the insert pocket of the bit holder is preferably open.

As known in the prior art, a driving opening for the shaft of a locking pin is formed in the front supporting wall in order to secure the inserted ploughing bit in the bit holder. The driving opening of the holder preferably changes into a driving groove formed in the inner surface of the shorter lateral supporting wall and/or into an engaging opening for the free shaft end, which engaging opening fully penetrates the rear supporting wall such that the locking pin can be favourably driven into the bit holder and the fine coal can be driven out and in the secured position the bit stem is anchored simultaneously in the front, the rear and the shorter lateral supporting walls. In a particularly advantageous embodiment the driving opening and the engaging opening are square-shaped with rounded corners in cross section. The clearance of the driving opening and the engaging opening is preferably constant in height and tapers in width as the driving depth increases. In a further advantageous embodiment the front supporting wall above the driving opening is provided with a protruding nose as protection for the head of the locking pin. In order to further improve the support of the ploughing bit inserted in the bit holder in this embodiment the front of the nose can be provided with a bevelling and/or a recess as additional support for the bit head of the ploughing bit. The recess can be particularly formed as a V-shape recess with flat sides. The intersection line between the two shoulder surfaces preferably aligns with the vertex of the elevation on the rear supporting wall and the central longitudinal plane.

In a further advantageous embodiment the working face side, i.e. the side flank of the rear supporting wall that is situated above the shorter lateral supporting wall, is provided with a particularly rounded, trough-shaped lowering. The lowering can slope down inwardly particularly towards the insert pocket in order to form a guiding surface on and/or above the shorter lateral supporting wall to ease the insertion of the bit shaft into the insert pocket.

An advantage is also achieved by a ploughing bit, particularly a bottom bit, having a bit head and a bit stem insertable into the insert pocket of the bit holder and once there anchored by means of a locking pin, which bit stem comprises two large-surface, substantially flat shaft sides forming the contact surfaces with the insert pocket. In accordance with one aspect of the invention, one of the shaft sides has a longer contact surface than the other shaft side while the shorter shaft side is provided with an open-edged engaging groove for the locking pin. In operation, a corresponding ploughing bit will rest with its longer goaf-sided contacting surface over the whole height of the insert pocket, having correspondingly a longer supporting surface or supporting wall.

BRIEF DESCRIPTION OF THE DRAWINGS

Further advantages and embodiments of a bit holder in accordance with one or more aspects of the invention and of a ploughing bit in accordance with one or more aspects of the invention arise from the following description of an exemplified embodiment of an asymmetrical ploughing bit pocket and an asymmetrical ploughing bit illustrated schematically in the drawings. In the drawings:

FIG. 1 schematically shows a bottom bit holder in a cross section view with an inserted and secured ploughing bit;

FIG. 2 shows a bit holder in perspective;

FIG 3. shows the bit holder from FIG. 2 in side view;

FIG. 4 is a view of the front of the bit holder from FIG. 2;

DETAILED DESCRIPTION

Figure 5:
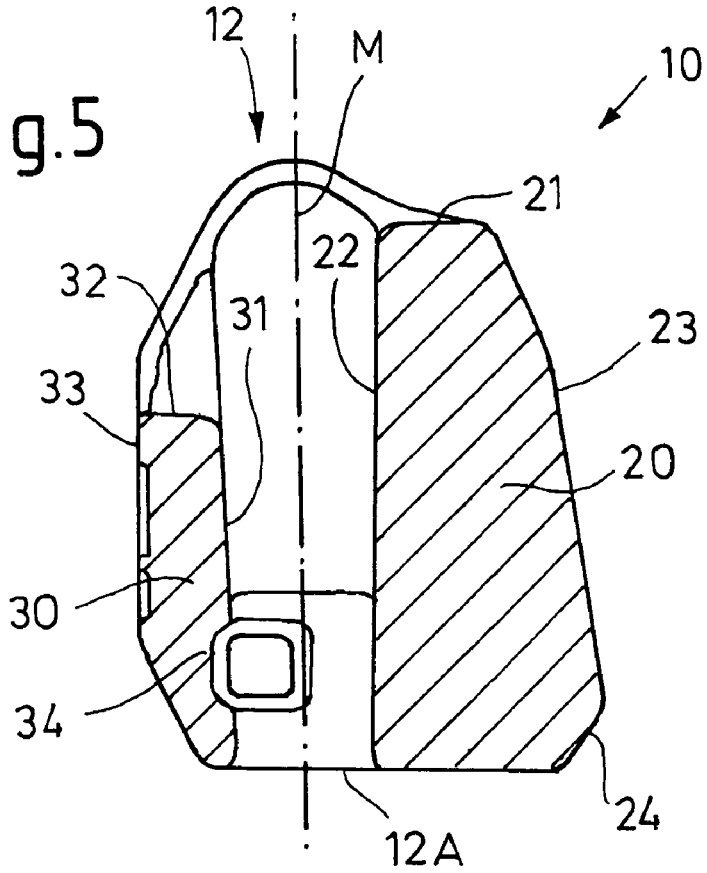
FIG. 5 is a view of the section along V—V in FIG. 3.
Figure 6:
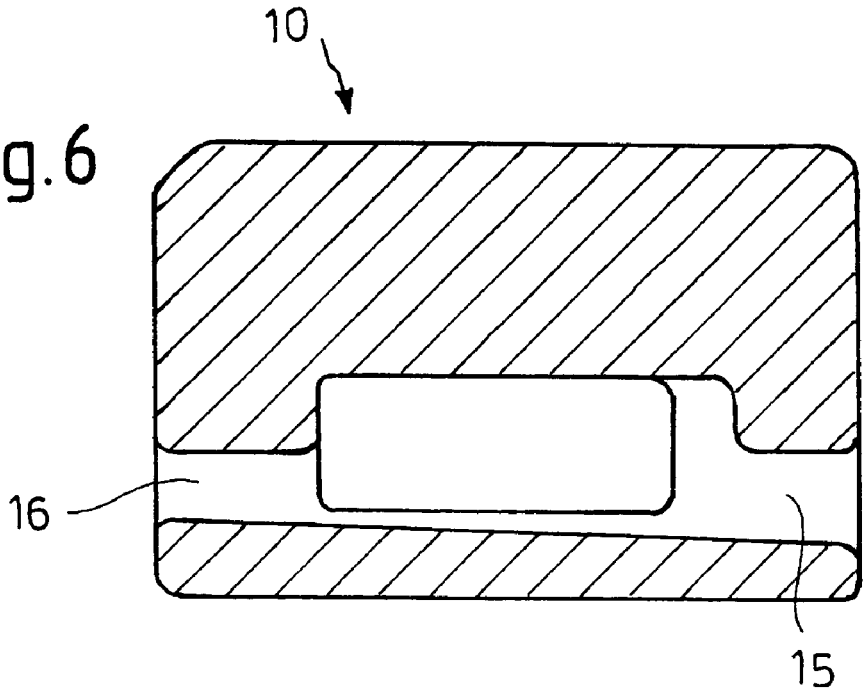
FIG. 6 is a view of the section along VI—VI in FIG. 3.

In the Figures, reference number 10 designates a bit holder comprising a casted bottom bit holder for a bottom bit 1 inserted therein. The bottom bit 1 comprises a bit head 2 disposed in the assembled state outside the bit holder 10 with a soldered-on hard alloy cutting plate 3A and at least one soldered-on hard alloy pin 3B on the cutting surfaces. A bit stem 5 is connected to the bit head 2 to form a single piece with the bit stem 5 being inserted in an open insert pocket 12 on the top side 11 of the bit holder 10 as shown in FIG. 1 and is positively received in the insert pocket 12. The bit stem 5 comprises two large-surface shaft sides whereof the shaft side 6 that is visible in FIG. 1 is provided with an engaging groove 8 that is aligned nearly parallel to the underside of the shaft 7 for the bolt shaft 51 of a locking pin indicated overall by reference number 50, by which means the assembly position of the bit 1 is secured in the insert pocket 12 of the bit holder 10.

The illustrated bit holder 10 is particularly designed to be welded to a not shown, pivotal bit carrier of an underground mining plough borne on a plough guide of a chain conveyor as the lowest or one of two lowest bit holders. For this purpose the bit holder 10 is welded with its underside 26 to the bit carrier such that the insert pocket 12 and/or the top side 11 of the bit holder 10 faces the bottom wall of a longwall working face in such a way that the cutting plate 3A and the cutting pin 3B of the bit 1 can detach coal at the transition of the bottom wall to the working face. In operation, the plough that is not shown is moved in the direction of arrow A in FIG. 1. Arrow A consequently indicates the plough working direction for the illustrated bottom bit 1 and in the assembled state the bit holder 10 is aligned on the bit carrier in such a way that the central longitudinal plane of the insert pocket 12 of the bit holder 10, as shown in FIG. 1, is aligned in parallel with the plough working direction A. In operation, with respect to the illustration in FIG. 1 and the plough working direction A, the visible shaft side 6 of the bit stem 5 faces the working face, while the opposite shaft side faces in the direction of the goaf side and the bit stem 5 is supported on its front 4 by a front supporting wall 13 of the bit pocket and on its rear side 9 by a rear supporting wall 14 in the insert pocket 12 of the bit holder 10. The front 4 of the bit stem 5 extends in a straight line over its whole height, although angled backwards with respect to the plough working direction A as far as the shaft underside 7, while the rear side 9 runs parallel to the front 4 over only a majority of the shaft height, nevertheless converting to a rear section 9A close to the underside, which rear section 9A forms a right angle with respect to the plough working direction A. The inner surfaces of the insert pocket 12 on the front and rear supporting wall 13, 14 are correspondingly inclined with respect to the plough working direction, with the angle of inclination being around 54.5°.

FIG. 1 further clearly shows that the pin shaft 51 of the securing pin 50 penetrates both a driving opening 15 in the front supporting wall 13 and an insert opening 16 in the rear supporting wall 14 of the bit holder 10 and/or engages therein and simultaneously lies partially in the engaging groove 8 in the shaft wall 6 of the bit stem 5. To secure the locking pin 50 in the assembled position, with its bolt head 52 resting on the outside 17 of the front supporting wall 13, a L-shaped synthetic clamping part 60 is disposed in a cavity 8A in the shaft side 6, the clamping part having a short locking bar 61 which is provided with a bore and/or circular recess and which L-shaped synthetic clamping part 60 engages in an engaging notch 53 on the locking pin 50. In order to remove it from the assembled position, therefore, a comparably large force in the direction of the arrow A, thus in the plough working direction, must be brought onto the bolt head 52. A tool is necessary to apply this force since when using the plough the forces exerted on the ploughing bit 1 are directed in the opposite direction to the plough working direction A. The principal structure described here of a bit holder 10, said bit holder 10 having a bit stem 5 of a ploughing bit 1 and said stem 5 of a ploughing bit 1 being inserted and secured in its insert pocket 12 is known to the person skilled in the art.

As indicated only schematically in FIG. 1, one of the two lateral supporting walls, namely the lateral supporting wall 20 that is goaf-sided in use and in FIG. 1 therefore lies behind the ploughing bit 1, is longer and higher than the other supporting wall that faces away from the working face and is not shown in FIG. 1. The longer supporting wall 20 simultaneously projects above the front supporting wall 13. This is clearly shown by the following description of the bit holder 10 illustrated in detail in the FIG. 2 to 6.

FIG. 2 shows that the insert pocket 12 of the bit holder 10 which is bounded by the front supporting wall 13, the rear supporting wall 14 and the two lateral supporting walls 20 and 21. Particularly when viewed in conjunction with FIGS. 3 and 5 it can be seen that the top side 21 of the supporting wall 20 that is goaf-sided in operation projects with a constant height above the top side 32 of the other supporting wall 30 that faces away from the working face by around ⅓ of the total length of the shorter supporting wall 30 over the whole length of the insert pocket 12. The inner surface 22 of the supporting wall 20 that bounds the insert pocket 12 therefore clearly forms a larger support surface for a bit stem above the height of the insert pocket 12 than the inner surface 31 of the shorter supporting wall 30. Since when in operation, i.e. when it travels in the plough working direction (A, FIG. 1) to extract coal the plough must be moved towards the working face by the required cutting depth, greater stress is exerted on the bit stem that is inserted in the bit holder 10 and the supporting wall 20 on the goaf-side than on the side facing away from the working face. The longer supporting surface on the inner surface 22 of the lateral supporting wall 20 and a significantly greater thickness of the supporting wall 20 are adapted to these stresses. The longer supporting surface of the supporting wall 20 when viewed over its height offers the particular advantage that a tilt moment brought to bear via the bit head to the bit stem is supported over almost the whole height of the bit stem on the goaf side. The whole section of the longer lateral supporting wall 20 that projects above the top side 18 of the front supporting wall 13 and the top side 32 of the shorter lateral supporting wall 30 consequently forms an additional, goaf-sided supporting shoulder for the goaf-sided shaft side of the bit stem of the ploughing bit.

The longer supporting wall 20 extends as far as a protruding nose 19 of the front supporting wall 13. Particularly FIG. 5 clearly shows, that both the top surface 21 of the longer supporting wall 20 and the top surface 32 of the shorter lateral supporting wall 30 hereby incline obliquely towards the insert pocket 12. Both top surfaces 21, 32 preferably each encompass an angle of around 93° with the central longitudinal plane M of the insert pocket 12. Simultaneously both inner surfaces 31, 22 of the lateral supporting walls 30, 20 diverge by a small angle of inclination of around 1.8° relative to the longitudinal central plane M, whereby the insert pocket 12 widens evenly on both sides from the open base 12A to the top surface 21, 32.

FIGS. 3 to 5 further show that the rear supporting wall 14 comprises an elevation 40 in its central area that not only projects slightly above the nevertheless shorter lateral supporting wall 30 but also projects slightly above the longer and thicker lateral supporting wall 20 again in order to form an additional top head-end support for the ploughing bit on the rear side of the insert pocket 12. The transition of the elevation 40 to the shorter lateral supporting wall 30 is in the form of a curved rounded transition section 41 in the top surface 32 of the shorter lateral supporting wall 30. The side flank of the rear supporting wall 14 that encompasses the transition section 41, which side flank extends to the side of the insert pocket 12 and above the shorter lateral supporting wall 30 is provided with a rounded trough-shaped lowering 42 that declines to the insert pocket 12 as a guiding aid for the insertion of the bit stem of the ploughing bit.

Particularly the FIGS. 4 and 5 show that the outer wall 23 of the longer lateral supporting wall 20 above a welding phase 24 that is formed close to the underside 13 of the insert pocket 10 runs obliquely with respect to the asymmetrically disposed central longitudinal plane M of the insert pocket 12 so that the thickness of the lateral supporting wall 20 decreases additionally as the height of the bit holder 10 increases. FIG. 4 further shows that the protruding nose 19 on the front supporting wall 14 is provided with a V-shaped bevelled groove, with both part surfaces 19A, 19B converging in an obtuse angle of between around 175° and 188°. While the protruding nose 19 offers a protection for the bolt head 52 (FIG. 1) of the bolt shaft, the V-shaped groove forms an additional supporting surface for a supporting tongue of the bit below the bit head (2, FIG. 1) of the bottom bit. In order to achieve an advantageous locking of the locking pin (50, FIG. 1) in the bit holder 10 the clearance height of the driving opening 15 and the insert opening 16 in the bit holder 10 remains substantially constant while its clearance width, i.e. the distance between the supporting walls 20, 30, decreases continuously as far as the insert opening 16, as particularly shown in FIG. 6.

From the above description it is clear to the person skilled in the art that the bit 1 shown in FIG. 1 comprises a shaft 5 whose rear side, not visible in FIG. 1, comprises a substantially longer, substantially flat contact surface for resting on the longer lateral supporting wall 20, than the front shaft side 5 visible in FIG. 1. By this means the bit in accordance with one aspect of the invention is adapted to the bit holder. In the case of the ploughing bit in accordance with this aspect of the invention the shaft sides themselves need not be formed flat across their whole surface, rather they may comprise further cavities in addition to the engaging groove for the locking pin. Nevertheless, a flat contact zone as achieved as an overall contact surface on the bounding surfaces of the insert pocket.

The exemplary embodiment has been described with reference to the embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. Bit holder for a ploughing bit of a coal or winning plough, comprising:

an insert pocket open at a top side for receiving and supporting a bit stem of the ploughing bit, the insert pocket bounded on edges thereof with respect to a plough working direction by two lateral supporting walls, a front supporting wall and a rear supporting wall with the rear supporting wall projecting above the front supporting wall, wherein a longer one of the lateral supporting walls that faces away from a working face when the plough is in use projects above the front supporting wall and the other shorter one of the lateral supporting walls and forms an extended lateral support for the bit stem with respect to the other supporting wall.

2. Bit holder according to claim 1, wherein the longer lateral supporting wall projects above the shorter lateral supporting wall as far as the front supporting wall at a substantially constant height.

3. Bit holder according to claim 1, wherein the insert pocket is asymmetrically disposed between the lateral supporting walls and is closer to an outer surface of the shorter lateral supporting wall than to an outside surface of the longer lateral supporting wall.

4. Bit holder according to claim 1, wherein the longer lateral supporting wall is thicker than the shorter lateral supporting wall.

5. Bit holder according to claim 4, wherein the thickness of the longer lateral supporting wall decreases continually over at least part of its height.

6. Bit holder according to claim 3, wherein the outside surface of the longer lateral supporting wall runs obliquely over a part of its height with respect to a central longitudinal plane of the insert pocket.

7. Bit holder according to claim 1, wherein the rear supporting wall comprises an elevation in a central area, which elevation projects above both lateral supporting walls and forms an additional backward support for the ploughing bit.

8. Bit holder according claim 1, wherein top surfaces of both lateral supporting walls are formed with or as inclinations that decline towards the insert pocket.

9. Bit holder according to claim 8, wherein the inclinations run at an angle of around 93° with respect to central longitudinal plane of the insert pocket.

10. Bit holder according to claim 1, wherein inner surfaces of the lateral supporting walls that bound the insert pocket are flat and their distances increase from the base of the insert pocket to the top side of the bit holder.

11. Bit holder according to claim 10, wherein the inner surfaces of both lateral supporting walls incline obliquely with respect to the central longitudinal plane of the insert pocket at an angle of around 1° to 2°, preferably 1.8°.

12. Bit holder according to claim 1, wherein inner surfaces of the front and rear supporting walls incline obliquely with respect to the plough working direction, with the angle of inclination being preferably around 50° to 60°, particularly around 54.5°±1°.

13. Bit holder according to claim 1, wherein the bottom of the insert pocket is open.

14. Bit holder according to claim 1, wherein a driving opening for a shaft of a locking pin is formed in the front supporting wall, which driving opening passes into a driving groove formed in an inner surface of the shorter lateral supporting wall and/or an engaging opening for the free shaft end that penetrates the rear supporting wall.

15. Bit holder according to claim 14, wherein the driving opening and the engaging opening are square-shaped with round corners in cross section, whereby the clearance width of the driving opening and the engaging opening is constant in height and tapers in width as the driving depth increases.

16. Bit holder according to claim 15, wherein the front supporting wall comprises a protruding nose as a protection for a locking bolt above the driving opening.

17. Bit holder according to claim 16, wherein a front end of the nose has an inclination and/or a groove as additional support for the bit head of the ploughing bit.

18. Bit holder according to claim 1, wherein a side flank of the rear supporting wall has a rounded, trough-shaped lowering above the shorter lateral supporting wall.

19. Bit holder according to claim 18, wherein the lowering declines obliquely towards the insert pocket.

20. Bit holder according to claim 1, wherein a bit head and bit stem of the ploughing bit are insertable into the insert pocket and anchorable therein by means of a locking pin, wherein one shaft side comprises a longer contact surface than the other shaft side, said longer contact surface having an open-edged engaging groove for the locking pin.

* * * * *